US011164427B2

(12) United States Patent
Kawai et al.

(10) Patent No.: US 11,164,427 B2
(45) Date of Patent: Nov. 2, 2021

(54) GAME APPARATUS

(71) Applicant: KONAMI AMUSEMENT CO., LTD., Ichinomiya (JP)

(72) Inventors: Norifumi Kawai, Ichinomiya (JP); Kenji Gennozono, Ichinomiya (JP); Ken Sasaki, Ichinomiya (JP); Takahiro Yoshino, Ichinomiya (JP); Etsushi Takahashi, Ichinomiya (JP); Shinya Suga, Ichinomiya (JP); Kensaku Yoshida, Ichinomiya (JP)

(73) Assignee: KONAMI AMUSEMENT CO., LTD., Ichinomiya (JP)

( * ) Notice: Subject to any disclaimer, the term of this patent is extended or adjusted under 35 U.S.C. 154(b) by 0 days.

(21) Appl. No.: 16/799,917

(22) Filed: Feb. 25, 2020

(65) Prior Publication Data

US 2020/0193781 A1 Jun. 18, 2020

Related U.S. Application Data

(63) Continuation of application No. PCT/JP2018/032155, filed on Aug. 30, 2018.

(30) Foreign Application Priority Data

Aug. 31, 2017 (JP) ..... JP2017-167831

(51) Int. Cl.
*A63F 9/00* (2006.01)
*G07F 17/32* (2006.01)

(52) U.S. Cl.
CPC ..... *G07F 17/3297* (2013.01); *A63F 9/00* (2013.01); *G07F 17/3216* (2013.01); *A63F 2250/136* (2013.01)

(58) Field of Classification Search
CPC .... G07F 17/3297; G07F 17/3216; A63F 9/00; A63F 2250/16
See application file for complete search history.

(56) References Cited

U.S. PATENT DOCUMENTS 7,971,880 B2 * 7/2011 Niwa ..... G07F 17/3297 273/138.3
2009/0033032 A1 * 2/2009 Niwa ..... G07F 17/3297 273/138.3

(Continued)

FOREIGN PATENT DOCUMENTS

CN 101246617 B 6/2010
EP 2462999 A1 * 6/2012 ..... A63F 7/00

(Continued)

OTHER PUBLICATIONS

Office Action dated Apr. 28, 2020 from Japanese Patent Office in JP Application No. 2017-167831.

(Continued)

*Primary Examiner* — Raleigh W Chiu
(74) *Attorney, Agent, or Firm* — Sughrue Mion, PLLC

(57) ABSTRACT

A game apparatus includes a pusher configured to reciprocate forward and backward on a surface of a table, the pusher including a first surface that is an upper surface of the pusher; a feeder configured to feed a game object that is rollable regardless of an orientation of the game object, onto the first surface; and a suppressor provided on at least one of the pusher and the table and configured to suppress an amount of movement of the game object.

7 Claims, 5 Drawing Sheets

(56) References Cited

U.S. PATENT DOCUMENTS

| | | | | |
|---|---|---|---|---|
| 2020/0188771 | A1* | 6/2020 | Sasaki | G07F 11/42 |
| 2020/0188773 | A1* | 6/2020 | Sasaki | G07F 17/3297 |
| 2020/0193781 | A1* | 6/2020 | Kawai | A63F 9/00 |

FOREIGN PATENT DOCUMENTS

| | | | | | |
|---|---|---|---|---|---|
| GB | 2124913 | A | * | 8/1982 | A63F 7/00 |
| GB | 2114452 | A | * | 8/1983 | A63F 11/00 |
| GB | 2446703 | A | * | 8/2008 | G07F 17/38 |
| GB | 2462541 | A | * | 2/2010 | G07F 17/38 |
| JP | 2000-153055 | A | | 6/2000 | |
| JP | 2001-113032 | A | | 4/2001 | |
| JP | 2004-113565 | A | | 4/2004 | |
| JP | 2005-218678 | A | | 8/2005 | |
| JP | 2006-68155 | A | | 3/2006 | |
| JP | 2007-215653 | A | | 8/2007 | |
| JP | 2007-296310 | A | | 11/2007 | |
| JP | 2008-194275 | A | | 8/2008 | |
| JP | 2009-183635 | A | | 8/2009 | |
| JP | 2010-68818 | A | | 4/2010 | |
| JP | 2010-110525 | A | | 5/2010 | |
| WO | WO-2019044986 | A1 | * | 3/2019 | G07F 17/3216 |

OTHER PUBLICATIONS

Office Action dated Jun. 2, 2020 from Japanese Patent Office in JP Application No. 2019-012043.
Communication dated Jun. 26, 2018, from the Japanese Patent Office in Application No. 2017-167831.
Communication dated Jun. 28, 2019, from the Intellectual Property Office of Taiwan in Application No. 107130354.
Communication dated Oct. 30, 2018, from the Japanese Patent Office in Application No. 2017-167831.
International Search Report in International Application No. PCT/JP2018/032155, dated Dec. 4, 2018.
Written Opinion in International Application No. PCT/JP2018/032155, dated Dec. 4, 2018.
Communication dated Feb. 13, 2018, from the Japanese Patent Office in Application No. 2017-167831.
Communication dated Dec. 8, 2020, from the Japanese Patent Office in JP Application No. 2019-012043.

* cited by examiner

GAME APPARATUS

CROSS REFERENCE TO RELATED APPLICATIONS

This application is a Continuation Application of PCT Application No. PCT/JP2018/032155, filed on Aug. 30, 2018, and is based on and claims priority from Japanese Patent Application No. 2017467831, filed on Aug. 31, 2017, the entire contents of each of which are incorporated herein by reference.

BACKGROUND OF THE INVENTION

Field of the Invention

The present invention relates to a game apparatus.

Description of Related Art

There is known in the art a conventional pusher game in which a pusher table is repetitively reciprocated forward and backward on a surface of a plate-like table, as described for example in Japanese Patent Application Laid-Open Publication No. 2010-110525. Many disk-shaped game objects (token coins) on the surface of the table are gradually moved by the pusher table, and then fill from the front end of the table.

There has been assumed a case in which token coins (medals) used in the conventional pusher games be replaced with, for example, game objects such as spherical objects. However, the game objects such as spherical objects freely move on the surface of the pusher table or on the surface of the table and thus easily fall from peripheral edges of the table. This results in a drawback in that attractiveness of the pusher game cannot be maintained in which game objects are gradually moved and caused to fall from ends of the table.

SUMMARY

In view of the circumstances described above, a preferred aspect of the present invention has as its object maintenance of attractiveness of a pusher game in which game objects are gradually moved and are caused to fall from a table, even when a configuration is used in which game objects are rollable in any direction.

To achieve the stated object a game apparatus according to a preferred aspect of the present invention comprises: a pusher configured to reciprocate forward and backward on a surface of a table, the pusher including a first surface that is an upper surface of the pusher; a feeder configured to feed a game object that is rollable regardless of an orientation of the game object, onto the first surface; and a suppressor provided on at least one of the pusher and the table and configured to suppress an amount of movement of the game object.

DESCRIPTION OF THE EMBODIMENTS

Preferred embodiments for carrying out the present invention are explained with reference to the figures. In the figures referred to in the following descriptions, dimensions and scales of elements may be different from those of actual products. The embodiments described below are preferred specific examples of the invention and the scope of the present invention is not limited to the embodiments described below.

Game Apparatus

Figure 1:
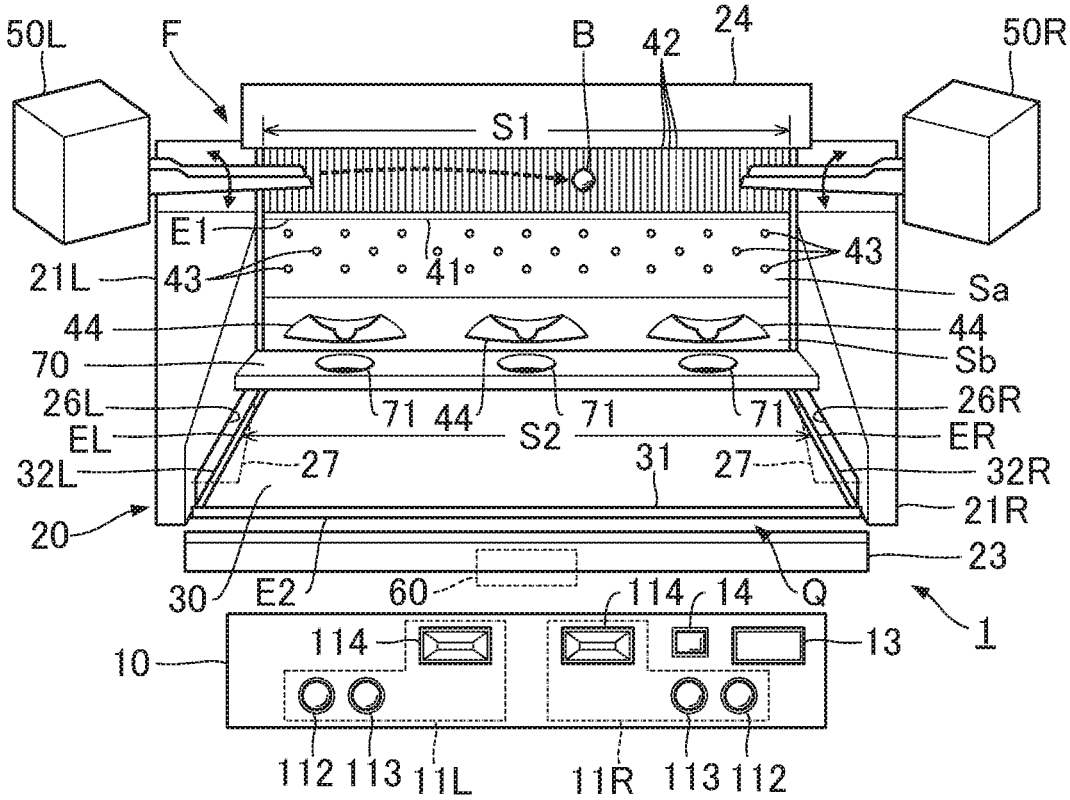
FIG. 1 is a perspective view of a game apparatus according to a preferred aspect of the present invention.

FIG. 1 is a perspective view illustrating a configuration of a game apparatus 1 according to a preferred aspect of the present invention. The game apparatus 1 is a device for play to be performed by a player and is installed in, for example, an entertainment facility such as a game arcade, a casino or commercial facilities such as a shopping mall. The game apparatus 1 may also be referred to as a gaming machine when used in a casino. The game apparatus 1 does not need to be a professional-use device installed in a commercial facility, and may be used, for example, as device for house-hold or individual use.

As shown in FIG. 1, the game apparatus 1 in the present embodiment includes an operating panel 10 and a game field F. The operating panel 10 is an input device that receives operations of a player. The game field F is a space in which a mechanism for providing to the player a pusher game (a table moving game) is installed.

As shown in FIG. 1, the operating panel 10 in the present embodiment includes an operating portion 11L, an operating portion 11R, a reader 13, and a payout portion 14. Each of the operating portion 11L and the operating portion 11R is configured to include an operator 112, an operator 113, and a slot 114. Each of the operator 112 and the operator 113 is an operation button that is pressed by the player. The slot 114 is an opening into which the player can input token coins (medals). The token coins may be game objects lent to the player from the store, coin money, or the like.

The reader 13 performs reading and writing of various types of information from/to a card in a non-contact manner. The card stores information on credits that are possessed by the player. The credits are virtual game values for use in the game. The credits may be values exchangeable for actual game values (for example, money) or values limited to use in the game, for example. Specifically, in a case in which the game apparatus 1 is used as a gaming machine in a casino, the credits are exchanged for actual game values (for example, money such as bank bills or coins). Further, the credits may be exchanged for a given number of token coins or tickets equivalent to the quantity of the credits. It is of note that the information on the credits need not be stored in the card. For example, the information on the credits may be stored in a server device that is communicable with the game apparatus 1 via a communication network. Specifically, the server device stores the information on the credits in association with identification information (for example, a card ID) assigned to the player or the card. The reader 13 acquires the identification information from the card, and the game apparatus 1 then acquires the information on the credits corresponding to the identification information from the server device.

The payout portion 14 is an operator for the player to instruct payout of token coins. When the player operates the payout portion 14, one or more token coins are output to a payout port (not shown). It is of note that the quantity of the credits stored in the card may be increased in accordance with the number of token coins when the payout portion 14 is operated. The quantity of the credits stored in the server device, with which the game apparatus 1 is communicable via the communication network, may be increased in accordance with the number of token coins.

Figure 2:
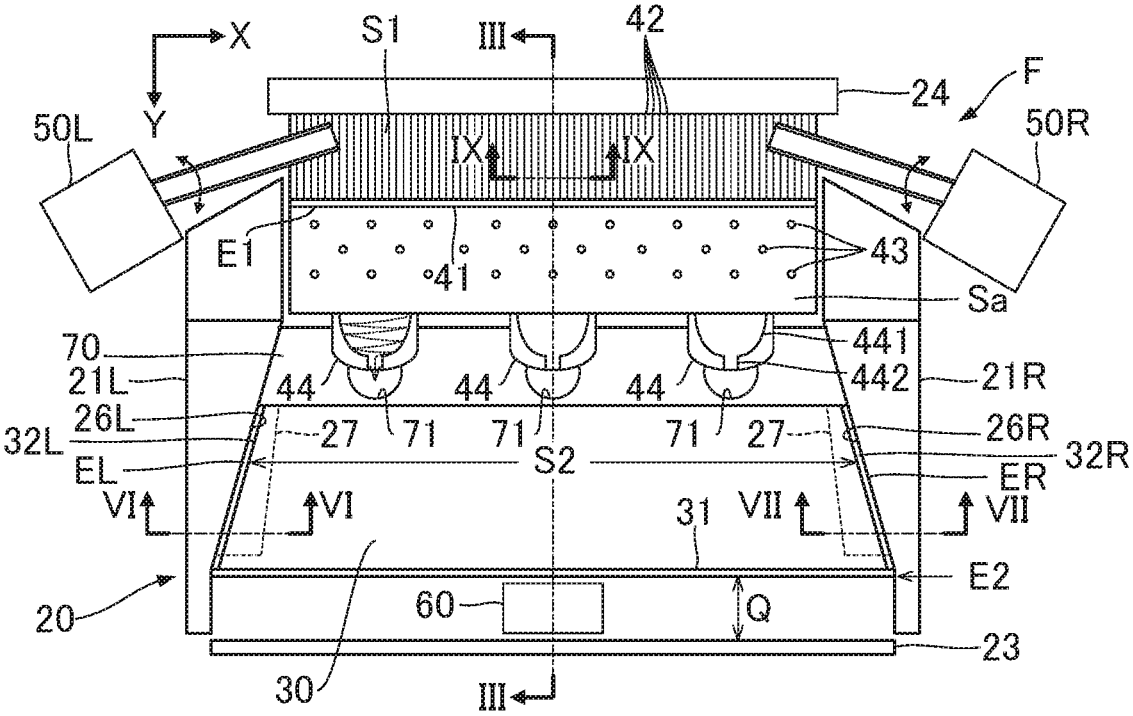
FIG. 2 is a plan view of the game apparatus according to the embodiment viewed from above.
Figure 3:
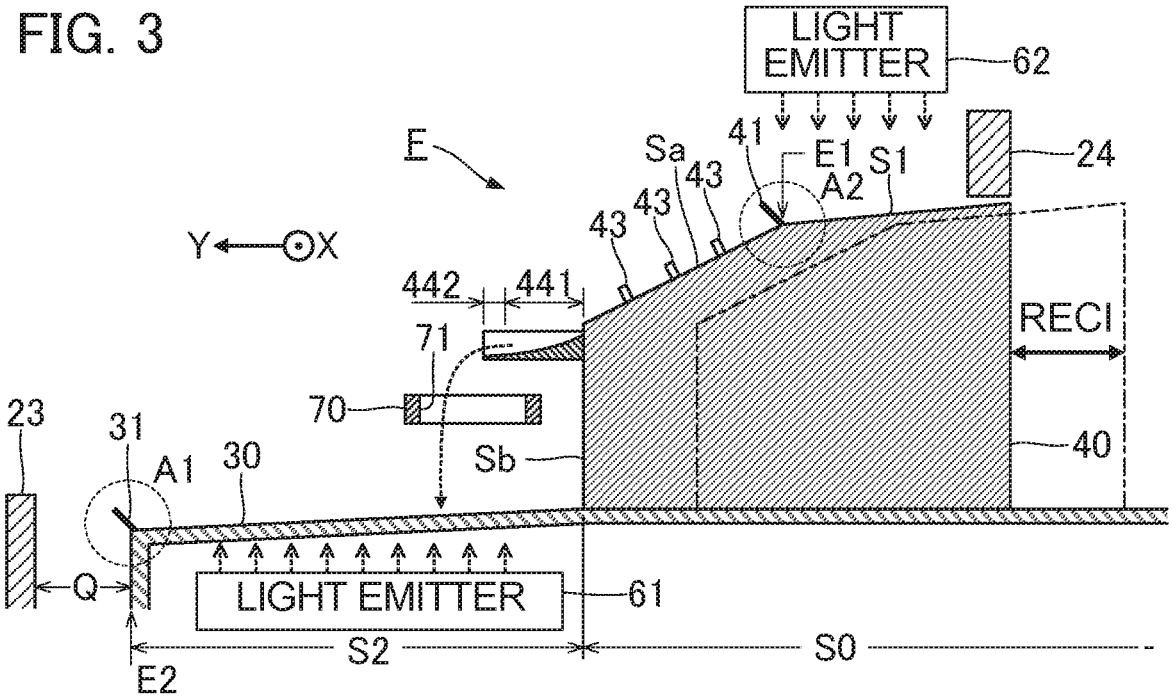
FIG. 3 is a sectional view taken along a line III-III in FIG. 2.

FIG. 2 is a plan view of the game field F viewed from above, and FIG. 3 is a sectional view taken along a line III-III in FIG. 2. For convenience, illustrations of the operating panel 10 are omitted in FIG. 2 and subsequent figures. In FIG. 3, "reciprocation" is referred to as "RECI." In the following explanations, the right-left direction of the game field F is referred to as an "X direction" and the front-back direction thereof is referred to as a "Y direction," as shown in FIG. 2 and FIG. 3. The positive side in the X direction is the right side as viewed from the player's side, and the negative side in the X direction is the left side as viewed from the player's side. The positive side in the Y direction is the front side (the near side as viewed from the player's side) and the negative side in the Y direction is the back side (the far side as viewed from the player's side). An X-Y plane corresponds to a horizontal plane.

As shown in FIG. 1 and FIG. 2, a frame 20, a table 30, a pusher 40, a feeder 50L, and a feeder 50R are provided in the game field F. The frame 20 is a structure that supports elements of the game apparatus 1 and is configured to include a side wall portion 21L, a side wall portion 21R, a front wall portion 23, and a back wall portion 24. The side wall portion 21L and the side wall portion 21R are respectively positioned on the left and right of the game field F to face each other. The table 30 and the pusher 40 are positioned between the side wall portion 21L and the side wall portion 21R. The front wall portion 23 is a member that extends in the X direction at a position spaced apart from a peripheral edge (hereafter, "front edge") E2 on the positive side in the Y direction of the table 30. That is, an opening (hereafter, "fall port") Q is formed between the front edge E2 of the table 30 and the front wall portion 23. The fall port Q is elongate in the X direction. The back wall portion 24 is a member that faces an upper surface (hereafter, "first surface") S1 of the pusher 40. The back wall portion 24 is elongate in the X direction.

The table 30 is a plate-like member provided substantially horizontally. The table 30 is formed from a light transmissive resin material such as an acrylic resin. As shown in FIG. 3, the upper surface of the table 30 is divided into a reciprocation surface S0 and a second surface S2. The reciprocation surface S0 is a flat surface that is substantially parallel to the horizontal plane (the X-Y plane). The second surface S2 is a region positioned on the positive side in the Y direction as viewed from the reciprocation surface S0.

The pusher 40 is a three-dimensional structure (a pusher table) that reciprocates forward and backward on the surface of the table 30. The pusher 40 is rephrased as a moving table or a reciprocator. Specifically, as shown in FIG. 3, the pusher 40 repetitively reciprocates in the Y direction on the face of the reciprocation surface S0. A direction in which the pusher 40 reciprocates may be defined as the Y direction and a direction orthogonal to the Y direction in the horizontal plane may be defined as the X direction.

The feeder 50L and the feeder 50R are mechanisms for feeding game objects B toward the first surface S1 of the pusher 40. The feeder 50L feeds game objects B onto the first surface S1 from the left side of the pusher 40 toward the positive side in the X direction as shown in FIG. 1. The feeder 50R feeds game objects B onto the first surface S1 from the right side of the pusher 40 toward the negative side in the X direction. The game objects B in the present embodiment are spherical objects (for example, marbles or balls) as shown in FIG. 1. Therefore, the game objects B are rollable on, for example, the first surface S1 of the pusher 40 or the second surface S2 of the table 30. The game objects B are made from a light transmissive material such as acrylic resin or glass.

Directions and timings of feeding of the game objects B by the feeder 50L and directions and timings of feeding of the game objects B by the feeder 50R are variable. By operating the operator 112 of the operating portion 11L on the operating panel 10 in FIG. 1, the player can change the feed direction of the game objects B by the feeder 50L. Specifically, the feed-direction by the feeder 50L repetitively changes within a predetermined range when the operator 112 is pressed, and settles in a single direction when the operator is no longer pressed. The same holds true for the feeder 50R. By operating the operator 112 of the operating portion 11R on the operating panel 10, the player can change the feed-direction by the feeder 50R. Game objects B are fed from the feeder 50L when the operator 113 of the operating portion 11L on the operating panel 10 is operated, and game objects B are fed from the feeder 50R when the operator 113 of the operating portion 11R is operated. It is of note that only one of the feeder 50L and the feeder 50R can be installed.

Figure 4:
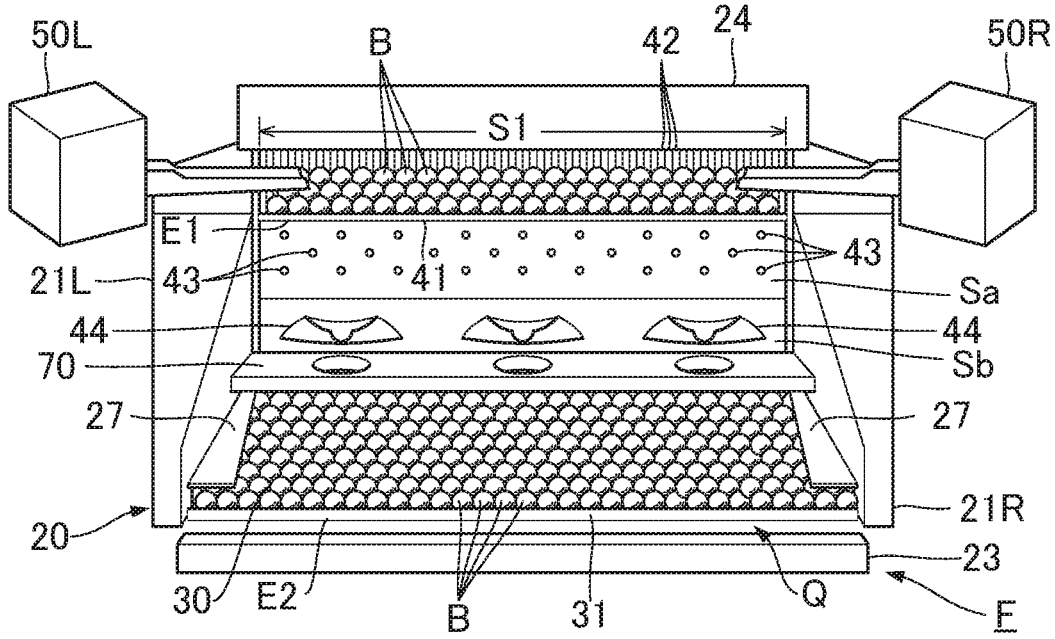
FIG. 4 is a perspective view of the game apparatus in a state in which game objects are placed on a game field.

FIG. 4 is a perspective view illustrating a state in which game objects B are positioned on the game field F shown in FIG. 1. As shown in FIG. 4, many game objects B are spread to cover the first surface S1 and the second surface S2 in an actual play situation. While the pusher 40 reciprocates forward and backward in the Y direction, the position of the back wall portion 24 in the Y direction is fixed. Therefore, game objects B, which are fed from each of the feeder 50L and the feeder 50R onto the first surface S1, are pushed by the back wall portion 24 while the pusher 40 moves backward (to the negative side in the Y direction). When the back wall portion 24 pushes the game objects B, the game objects B are sequentially moved and some game objects B, which are positioned near a peripheral edge (hereafter, "front edge") E1 of the pusher 40 on the positive side in the Y direction, fill from the first surface S1 onto the second surface S2 of the table 30. When game objects B on the second surface S2 are pushed by the pusher 40 that moves forward, the game objects B are sequentially moved. As a result, game objects B, which are positioned near the front edge E2 of the table 30, fall from the second surface S2 into the fall port Q.

As shown in FIG. 1 and FIG. 2, a detector 60 is installed in the fall port Q. The detector 60 detects a game object B. A reward corresponding to a number of game objects B detected by the detector 60 is given to the player. For example, a numerical value corresponding to the number of game objects B is added as a reward to the credits of the player. It is of note that a quantity of token coins, corresponding to the number of game objects B that have fallen into the fall port Q, may be output as a reward from a payout port (not shown).

As shown in FIG. 3, a light emitter 61 is provided below the table 30. The light emitter 61 is a light source that illuminates the table 30 and is configured to include a light-emitting device such as an LED (Light Emitting Diode). Because the game objects B and the table 30 are light transmissive as described above, light emitted from the light emitter 61 passes through the table 30. The light scatters moderately while passing through the game objects B, and is viewable by the player. A light emitter 62 is provided above the pusher 40. The light emitter 62 is a light source that illuminates the first surface S1 of the pusher 40 and is configured to include a light-emitting device such as an LED. Light emitted from the light emitter 62 scatters moderately while passing through the game objects B, and is viewable by the player. As will be understood from the above explanations, a design feature is realized whereby game objects B on the first surface S1 and game objects B on the second surface S2 are imparted with a visual effect of being electronically illuminated.

In a configuration in which the light emitter 62 is mounted to the inner part of the pusher 40, the light emitter 62 moves with the pusher 40. Accordingly, a mechanism is required for supplying power to the light emitter 62 regardless of a position in which the pusher 40 is positioned within the reciprocation range. In the present embodiment, the light emitter 62 is mounted exterior to the pusher 40. As a result, an advantage is obtained in that power can be steadily supplied to the light emitter 62 by use of a simple configuration regardless of a position of the pusher 40.

As shown in FIG. 1 to FIG. 3, a first restrictor 31 is provided on the table 30. The first restrictor 31 is a member that protrudes from the second surface S2 along the front edge E2 of the table 30. Specifically, the first restrictor 31 extends linearly in the X direction (that is, a direction intersecting with the Y direction in which the pusher 40 reciprocates) over the entire front edge E2.

Figure 5:
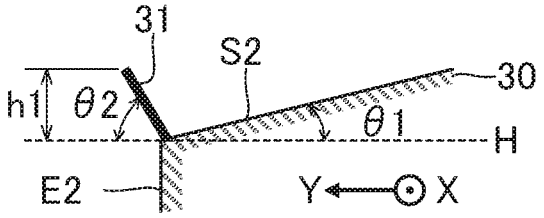
FIG. 5 is an enlarged view of a region A1 in FIG. 3.

FIG. 5 is a sectional view illustrating a region A1 near the first restrictor 31 in FIG. 3 in enlargement. As shown in FIG. 5, the second surface S2 is inclined at an angle θ1 (an illustrative example of a first angle) relative to a horizontal plane H such that the front part (the part on the positive side in the Y direction) of the second surface S2 is lower than the back part thereof. As a result, game objects B on the second surface S2 move to a vicinity of the front edge E2 of the second surface S2 and stop upon abutting the first restrictor 31. Some game objects B, moving beyond the first restrictor 31 among the game objects B on the second surface S2, fall into the fall port Q. As will be understood from the above explanations, the restrictor 31 suppresses many game objects B from freely falling from the front edge E2 of the second surface S2 into the fall port Q. Therefore, in the configuration using rollable spherical game objects B, attractiveness of the pusher game can be maintained in which game objects B are gradually moved and are caused to fall from the table 30.

As shown in FIG. 5, the first restrictor 31 is inclined at an angle θ2 (an illustrative example of a second angle) relative to the horizontal plane H such that the part on the positive side in the Y direction of the first restrictor 31 is higher than the part on the negative side in the Y direction of the first restrictor 31. A height h1 of the first restrictor 31 from the horizontal plane H is smaller than the diameter (more preferably, the radius) of the game objects B. As shown in FIG. 5, the angle θ2 is larger than the angle θ1 (θ2>θ1). Specifically, the angle θ1 is not smaller than 0° and is not larger than 90°, and the angle θ2 is set to an appropriate angle that is larger than the angle θ1 within a range larger than 0° and equal to or smaller than 90°. According to the above configuration, movement (specifically, falling into the fall port Q) of the game objects B can be more effectively suppressed by the first restrictor 31 as compared to a configuration in which the angle θ2 of the first restrictor 31 is equal to or smaller than the angle θ1 of the second surface S2.

As shown in FIG. 1, an elongated opening 26L is formed on the side wall portion 21L. The opening 26L extends along a peripheral edge (hereafter, "side edge") EL on the negative side in the X direction of the table 30. Similarly, an elongated opening 26R is formed on the side wall portion 21R. The opening 26R extending along a side edge ER on the positive side in the X direction of the table 30 is formed on the side wall portion 21R. When game objects B on the second surface S2 are pushed by the pusher 40, some game objects B near the side edge EL move to the negative side in the X direction to pass through the opening 26L and fall from the table 30 (so-called "fall from side holes" (out-zone)). Similarly, some game objects B near the side edge ER move to the positive side in the X direction to pass through the opening 26R and fall from the table 30. Game objects B are retained inside the game apparatus 1 after falling from the table 30 through the opening 26L or the opening 26R. That is, while a reward is given to the player when game objects B fall into the fall port Q, no reward is given to the player even when game objects B fall through the opening 26L or the opening 26R. As show in FIG. 4, one of one shielding plates 27 is provided near the opening 26L and the other of shielding plates 27 is provided near the opening 26R. Therefore, the player is not able to see the opening 26L and the opening 26R. It is of note that game objects B may be caused to fall (fall from side holes) through cutouts formed in the table 30 along the side edge EL and the side edge ER, respectively. The cutouts are openings with a width larger than the diameter of the game objects B. The opening 26L and the opening 26R may be omitted in a configuration in which the cutouts are formed.

Figure 6:
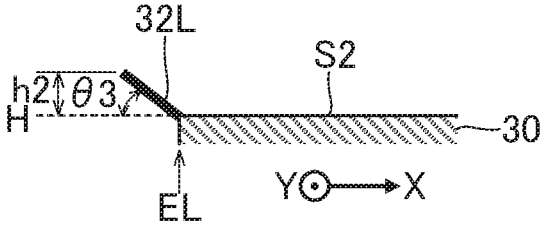
FIG. 6 is a sectional view in which a vicinity of a left side edge of a table is shown in enlargement (a sectional view along a line VI-VI in FIG. 2).

FIG. 6 is a sectional view of a vicinity of the side edge EL of the table 30 (a sectional view taken along a line VI-VI in FIG. 2). As shown in FIG. 6, a second restrictor 32L is mounted to the table 30. The second restrictor 32L protrudes from the second surface S2 along the side edge EL. The second restrictor 32L is an elongate member extending along the entire edge EL.

As shown in FIG. 6, the second restrictor 32L is inclined at an angle θ3 (an illustrative example of a third angle) relative to the horizontal plane H such that the height of a position in the second restrictor 32L increases depending on an increase in a distance between the position in the second restrictor 32L and the edge of the second restrictor 32L on a positive side in the X direction. A height h2 of the second restrictor 32L from the horizontal plane H (the second surface S2) is smaller than the diameter (more preferably, the radius) of the game objects B. In the above configuration, game objects B move to the vicinity of the side edge EL and stop upon abutting the second restrictor 32L. That is, movement of the game objects B is suppressed. Some game objects B among those near the side edge EL move beyond the second restrictor 32L, pass through the opening 26L and fall. As will be understood from the above explanations, the second restrictor 32L suppresses many game objects B from freely falling (fall from side holes) from the side edge EL of the second surface S2 through the opening 26L.

Figure 7:
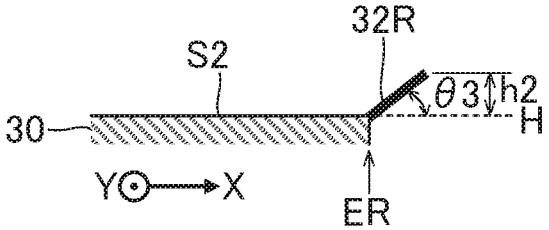
FIG. 7 is a sectional view in which a vicinity of a right side edge of the table is shown in enlargement (a sectional view along a line VII-VII in FIG. 2).

FIG. 7 is a sectional view of a vicinity of the side edge ER of the table 30 (a sectional view along a line VII-VII in FIG. 2). As shown in FIG. 7, a second restrictor 32R is mounted to the table 30. The second restrictor 32R protrudes from the second surface S2 along the side edge ER. The second restrictor 32R is an elongate member extending along the entire edge ER.

As shown in FIG. 7, the second restrictor 32R is inclined at the angle θ3 relative to the horizontal plane H such that the height of a position in the second restrictor 32R increases depending on an increase in a distance between the position in the second restrictor 32R and the edge of the second restrictor 32L on a negative side in the X direction. A height h2 of the second restrictor 32R from the horizontal plane H (the second surface S2) is smaller than the diameter (more preferably, the radius) of the game objects B. In the above configuration, game objects B move to the vicinity of the side edge ER and stop because of abutting on the second restrictor 32R. Some game objects B among the game objects B near the side edge ER move beyond the second restrictor 32R, pass through the opening 26R and fall. As is understood from the above explanations, the second restrictor 32R suppresses many game objects B from freely falling from the side edge ER of the second surface S2 through the opening 26R.

The angle θ3 of the second restrictor 32L and the angle θ3 of the second restrictor 32R are larger than the angle θ1 of the second surface S2 (θ3>θ1). According to the above configuration, movement (fall from side holes) of game objects B near the side edge EL or the side edge ER can be more effectively suppressed in comparison with a configuration in which the angle θ3 is equal to or smaller than the angle θ1. Further, the angle θ3 of the second restrictor 32L and the angle θ3 of the second restrictor 32R are smaller than the angle θ2 of the first restrictor 31 (θ3<θ2). That is, the probability of moving of game objects B beyond the second restrictor 32L or the second restrictor 32R (that is, the probability of fall from side holes) is generally higher than the probability of moving of game objects B beyond the first restrictor 31 and falling in the fall port Q. In this way, attractiveness of the pusher game can be maintained.

As shown n FIGS. 2 and 3, in the present embodiment a third restrictor 41 is mounted on the pusher 40. The third restrictor 41 is a member that protrudes from the first surface S1 along the front edge E1 of the pusher 40. Specifically, the third restrictor 41 extends in the X direction (that is, in a direction that intersects the Y direction in which the pusher 40 reciprocates) along the entire front edge E1.

Figure 8:
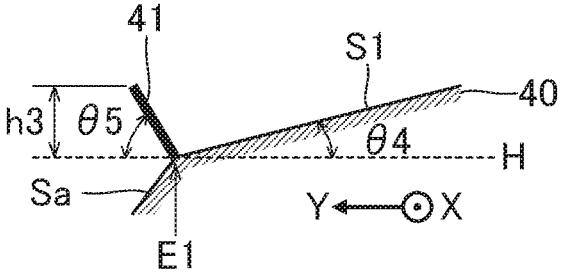
FIG. 8 is an enlarged view of a region A2 in FIG. 3.

FIG. 8 is a sectional view illustrating a region A2 near the third restrictor 41 in FIG. 3 in enlargement. As shown in FIG. 8, the first surface S1 is inclined at an angle θ4 (an illustrated example of a fourth example) relative to the horizontal plane H such that the front part (the part on the positive side in the Y direction) of the first surface S1 is lower than the back part thereof. A height h3 of the third restrictor 41 from the horizontal plane H (the first surface S1) is smaller than the diameter (more preferably, the radius) of the game objects B.

Game objects B on the first surface S1 move to a vicinity of the front edge E1 of the first surface S1 and stop because of abutting on the third restrictor 41. Some game objects B among those on the first surface S1 move beyond the third restrictor 41, and fall onto the second surface S2 of the table 30. As will be understood from the above explanations, the third restrictor 41 suppresses many game objects B from freely falling from the front edge E1 of the first surface S1. Therefore, by employing the configuration in which rollable game objects B are used, attractiveness of the pusher game can be maintained such that game objects B are gradually moved and caused to fall from the table 30.

As shown in FIG. 8, the third restrictor 41 is inclined at an angle θ5 (an illustrated example of a fifth angle) relative to the horizontal plane H such that the height of a position in the third restrictor 41 increases depending on an increase in a distance between the position in the third restrictor 41 and the edge of the third restrictor 41 on a negative side in the Y direction. The angle θ5 is larger than the angle θ4 (θ5>θ4). Specifically, the angle θ4 is not smaller than 0° and not larger than 90°, and the angle θ5 is set to an appropriate angle that is larger than the angle θ4 within a range larger than 0° and equal to or smaller than 90°. By employing the above configuration, movement (specifically, falling onto the table 30) of game objects B can be more effectively suppressed as compared with a configuration in which the angle θ5 of the third restrictor 41 is equal to or smaller than the angle θ4 of the first surface S1.

Figure 9:
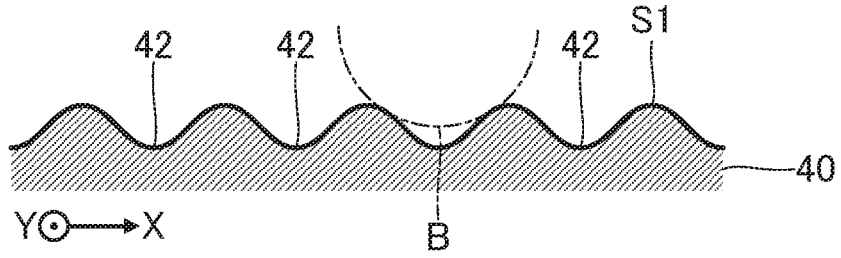
FIG. 9 is a sectional view along a line IX-IX in FIG. 2.

FIG. 9 is a sectional view taken along a line IX-IX in FIG. 2. As shown in FIG. 2 and FIG. 9, grooves 42 along the Y direction (that is, the direction of reciprocation of the pusher 40) are formed on the first surface S1 of the pusher 40. The grooves 42 are arrayed in the X direction at substantially equal intervals; as an alternatively stated, configuration, peaks are formed on the first surface S1 and extend in the Y direction between two adjacent grooves 42. The interval between the two adjacent grooves 42 in the X direction is smaller than the diameter of the game objects B, and the depth of each of the grooves 42 is smaller than the diameter of the game objects B. While the grooves 42 of a curved shape (a wave shape in cross section) are shown in FIG. 9, the shape of the grooves 42 can be changed, as appropriate. For example, the grooves 42 may be shaped as a combination of flat surfaces (for example, an accordion shape) may be formed on the first surface S1. Intervals between the grooves 42 may differ depending on the position in the X direction.

As explained with reference to FIG. 1, the feeder 50L and the feeder 50R feed game objects in the X direction. Therefore, in a configuration in which the first surface S1 is a simple flat surface, game objects B fed from the feeder 50L move across the first surface S1 to reach an end on the positive side in the X direction and game objects B fed from the feeder 50R move across the first surface S1 to reach an end on the negative side in the X direction. That is, game objects B cannot be fed at a halfway position on the first surface S1 by an operation of the player. In the present embodiment, because the grooves 42 along the Y direction are formed on the first surface S1, game objects B fed in the X direction from the feeder 50L or the feeder 50R are suppressed from freely reaching an end on the opposite side of the pusher 40. Therefore, attractiveness of the pusher game can be maintained such that the fed game objects B are positioned in accordance with an intension of the player.

When the pusher 40 reciprocates forward and backward, game objects B on the first surface S1 move on the first surface S1 in the Y direction along the grooves 42. That is, the grooves 42 suppress the game objects B on the first surface S1 from moving in the X direction with reciprocation of the pusher 40. As will be understood from the above explanations, the grooves 42 function to restrict movement in the X direction of game objects B on the first surface S1 (in other words, act as guides for game objects B in the Y direction).

The pusher 40 is configured to include an inclined surface Sa and a push surface Sb in addition to the first surface S1 explained above, as shown in FIG. 3. The push surface Sb is a walled surface erected substantially perpendicularly to the reciprocation surface S0 of the table 30. Game objects B on the second surface S2 are pushed in the Y direction by the push surface Sb due to reciprocation of the pusher 40. The push surface Sb may be inclined relative to the reciprocation surface S0.

The inclined surface Sa is an exterior surface inclined in a direction to the front side relative to the first surface S1 of the pusher 40. Specifically, the inclined surface Sa is inclined relative to the first surface S1 such that the height of a position in the inclined surface Sa decreases depending on an increase in a distance between the position in the inclined surface Sa and the edge of the inclined surface Sa on a negative side in the Y direction. The angle of the inclined surface Sa relative to the horizontal plane is larger than the angle θ4 of the first surface S1 relative to the horizontal plane. That is, the inclined surface Sa is steeper than the first surface S1.

As shown in FIGS. 2 and 3, protrusions 43 are provided on the inclined surface Sa. The protrusions 43 extend from the inclined surface Sa of the pusher 40. Each of the protrusions 43 is columnar in form, such as a circular column or a rectangular column, or a cone (or a frustum) such as a circular cone, or a pyramid. The protrusions 43 are dispersed over the inclined surface Sa, and are spaced apart from each other at intervals. An interval between two protrusions 43 adjacent to each other is larger than the diameter of the game objects B. Therefore, game objects B move from the first surface S1 beyond the third restrictor 41, fallen onto the inclined surface Sa, irregularly move between the protrusions 43 while colliding against the protrusions 43, and fall from the lowest end of the inclined surface Sa (that is, the boundary between the inclined surface Sa and the push surface Sb) onto the second surface S2 of the table 30. That is, the protrusions 43 suppress linear movement of the game objects B on the inclined surface Sa. By employing the above configuration, the attractiveness of the pusher game can be maintained in which game objects B are gradually moved and are caused to fall from the table 30.

Retaining members 44 are provided on the push surface Sb (that is, the front surface) of the pusher 40. Each of the retaining members 44 is a structure that protrudes forward from the push surface Sb. Specifically, the retaining members 44 are arrayed in the X direction and are spaced apart from each other at intervals in an upper region of the push surface Sb. Each of the retaining members 44 is formed from a light transmissive resin material such as acrylic resin.

As shown in FIG. 2, each of the retaining members 44 is a structure that has a concave portion 441 and a guide path 442, each of which are formed on the upper surface of the retaining member 44. The concave portion 441 is a curved indent (for example, a spherical shape or a cylindrical shape) that allows the game objects B to smoothly move. As shown in FIG. 3, the surface of the concave portion 441 is a curved surface. The front part of the curved surface is lower than the other part of the curved surface. The guide path 442 is a dent (specifically, a groove-like path along the Y direction) formed on the front part of the concave portion 441 and in communication with the concave portion 441.

Game objects B, falling from the inclined surface Sa other than from immediately above the retaining members 44, directly reach the second surface S2 of the table 30 without coming into contact with any retaining members 44. Meanwhile, game objects B, falling from positions on the inclined surface Sa immediately above the retaining members 44, are caught in the concave portions 441 of the retaining members 44 before falling onto the second surface S2. Game objects B, that have fallen into the concave portions 441 of the retaining members 44, gradually move forward (to the side of the guide paths 442) while repetitively swinging right and left along the curvatures of the surfaces of the concave portions 441, and fall from the ends of the concave portions 441 through the guide paths 442, as indicated by the broken line in FIG. 2. As will be understood from the above explanations, the retaining members 44 retain the game objects B that have fallen from the first surface S1 and the inclined surface Sa of the pusher 40.

As shown in FIG. 2 and FIG. 3, a hanging body 70 is provided between the side wall portion 21L and the side wall portion 21R. The hanging body 70 is an elongate plate-like member that linearly extends in the X direction from the side wall portion 21L to the side wall portion 21R. The hanging body 70 is provided at a level that is spaced at an interval larger than the diameter of the game objects B apart from the second surface S2 of the table 30. Specifically, the hanging body 70 overlaps with the push surface Sb of the pusher 40 as viewed from the Y direction.

As shown in FIG. 1 to FIG. 3, a plurality (three) of pass holes 71 respectively corresponding to the different retaining members 44 are formed in the hanging body 70. Each of the pass holes 71 is a substantially circular through-hole formed to have an inside diameter larger than the diameter of the game objects B. As a result, the game objects B can pass through the pass holes 71. A pass hole 71 corresponding to a particular retaining member 44 is arranged at a position corresponding to the retaining member 44 in the X direction. Specifically, the position in the X direction of the guide path 442 of the retaining member 44 substantially matches the position in the X direction of the center of the pass hole 71 corresponding to the retaining member 44.

While the retaining members 44 reciprocate in the Y direction along with the pusher 40, the position of the hanging body 70 in the Y direction is fixed. That is, the retaining members 44 repetitively move close to and away from the hanging body 70. In a state in which the pusher 40 reaches the forward most side in the reciprocation range (that is, in a state in which the retaining members 44 are closest to the hanging body 70), the pass holes 71 of the hanging body 70 are positioned immediately below the guide paths 442 of the retaining members 44, as shown in FIG. 3. Therefore, in a case that game objects B fall from the guide paths 442 of the retaining members 44 at a time when the pusher 40 is sufficiently close to the hanging body 70 (that is, at a time when the pusher 40 is positioned near the front end of the reciprocation range), the game objects B pass through the corresponding pass holes 71 and then fall onto the second surface S2 of the table 30. Meanwhile, game objects B, falling from the guide paths 442 of the retaining members 44 at a time when the pusher 40 is positioned away from the hanging body 70, fall onto the second surface S2 of the table 30 without passing through the pass holes 71.

That is, whether game objects B pass through the pass holes 71 depends on a position of the pusher 40 in the Y direction at a time when the game objects B fall from the retaining members 44.

A detector (not shown) configured to detect passage of a game object B is provided on an inner circumferential surface of each of the pass holes 71. When the detector (a checker) detects passage of a game object B, lottery processing such as a slot game is performed the player is rewarded conditional upon winning the lottery. A predetermined number of game objects B may be fed onto the first surface S1 or the second surface S2 according to a result of lottery processing. Alternatively, a game object (a large ball) having a diameter larger than the normal game objects B may be fed onto the first surface S1 or the second surface S2 conditional upon winning the lottery. As will be understood from the above explanations, attractiveness is realized such that the player adjusts the timing of feeding game objects B (operating operators) with a goal that game objects B, which have fallen from the first surface S1, pass through the pass holes 71.

Modifications

The embodiment illustrated above can be variously modified. Specific illustrative modifications applicable to the above embodiment are set out below. Two or more aspects arbitrarily selected illustrative modifications selected from the following may be combined with one another so long as such a combination remains within the scope of the invention and does not give rise to any contradictions.

Figure 10:
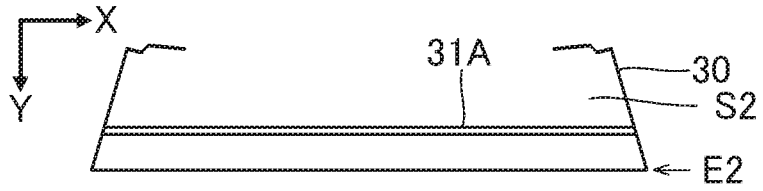
FIG. 10 is a plan view illustrating a configuration of a first restrictor according to a modification.
Figure 11:
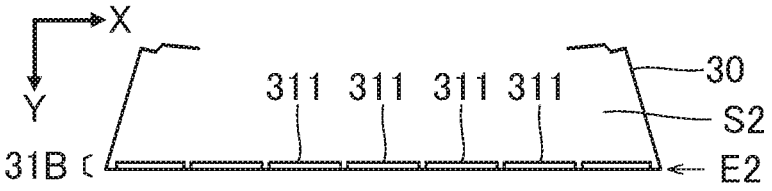
FIG. 11 a plan view illustrating a configuration of the first restrictor according to the modification.
Figure 12:
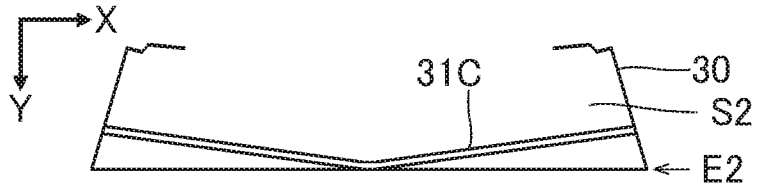
FIG. 12 a plan view illustrating a configuration of the first restrictor according to the modification.

(1) In the embodiment described above, the first restrictor 31 extending in the X direction along the entirety of the front edge E2 of the table 30 is shown as an example. However, the specific form of the first restrictor 31 is not limited to the above example. For example, as shown in FIG. 10, a first restrictor 31A may be arranged on the second surface S2 at a position spaced apart from the front edge E2 of the table 30 (a position between the front edge E2 and a back edge of the second surface S2). As shown in FIG. 11, a first restrictor 31B may be constituted from parts 311 arranged in the X direction at intervals smaller than the diameter of the game objects B. The direction in which the first restrictor 31 extends is not limited to the X direction (a direction orthogonal to the direction of reciprocation of the pusher 40). For example, as shown in FIG. 12, a first restrictor 31C may extend in directions that incline relative to the X direction. Similarly, the second restrictor 32 (32L, 32R) may also be arranged on the second surface S2 at a position spaced apart from the peripheral edge (the side edge EL or the side edge ER) of the table 30, or the second restrictor 32 may be constituted from a plurality of parts. Although the plate-like first restrictor 31 that protrudes from the second surface S2 is shown as an example in the above embodiment, the first restrictor 31 may be a portion that protrudes in a curved form from the second surface S2 (or the horizontal plane H). That is, a contact face of the first restrictor 31 with game objects B may be planar or curved. Similarly, a contact face of the second restrictor 32 (32L, 32R) with game objects B may also be planar or curved.

Figure 13:
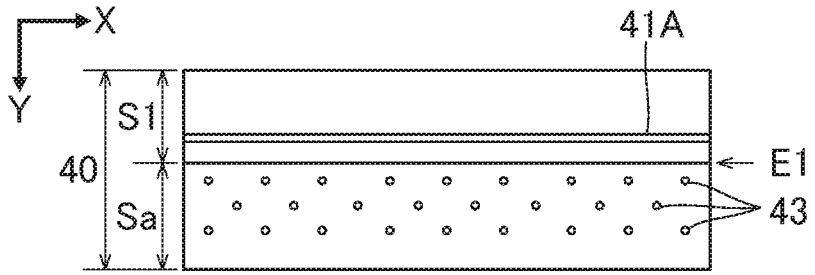
FIG. 13 is a plan view illustrating a configuration of a third restrictor according to the modification.
Figure 14:
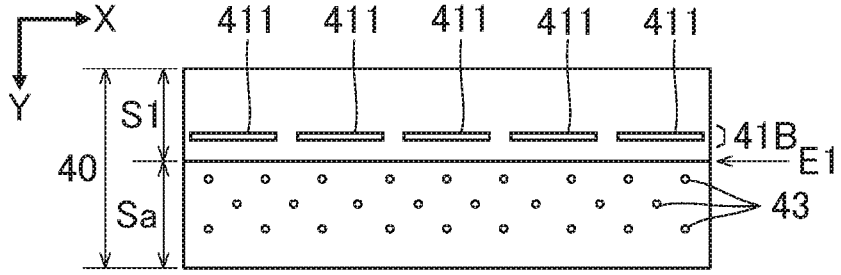
FIG. 14 a plan view illustrating a configuration of the third restrictor according to the modification.
Figure 15:
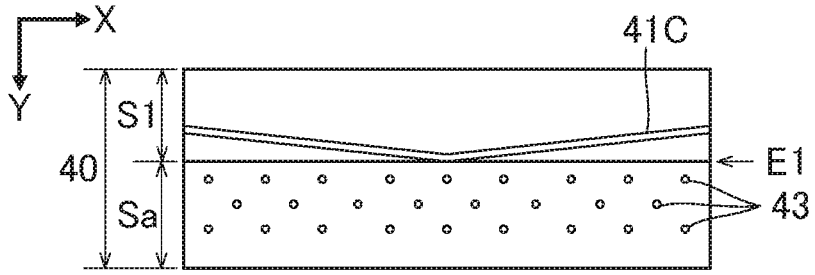
FIG. 15 a plan view illustrating a configuration of the third restrictor according to the modification.

(2) In the above embodiment, the third restrictor 41 extending in the X direction along the entire front edge E1 of the pusher 40 is shown as an example. However, a specific form of the third restrictor 41 is not limited to the above example. For example, as shown in FIG. 13, a third restrictor 41A may be arranged on the first surface S1 at a position spaced apart from the front edge E1 (a position between the front edge E1 and a back edge on the first surface S1). As shown in FIG. 14, a third restrictor 41B may be constituted by parts 411 arrayed at intervals smaller than the diameter of the game objects B. For example, as show in FIG. 15, a third restrictor 41C may extend in directions that incline relative to the X direction. Further, although the plate-like third restrictor 41 that protrudes from the first surface S1 is shown in the above embodiment, the third restrictor 41 may be a portion that protrudes in a curved form from the first surface S1. That is, a contact face of the third restrictor 41 with game objects B may be planar or curved.

(3) In the above embodiment, a possibility that the game objects B move beyond the second restrictor 32 (that is, the possibility of fall from side holes) is set to be higher than the possibility that the game objects B move beyond the first restrictor 31 by setting the angle θ3 of the second restrictor 32 (32L and 32R) to be smaller than the angle θ2 of the first restrictor 31. In order to realize substantially the same effects, the second restrictor 32 may be formed lower than the first restrictor 31. That is, the height h2 of the second restrictor 32 relative to the second surface S2 (or the horizontal plane H) may be set to be lower than the height h1 of the first restrictor 31 from the second surface S2 (or the horizontal plane H). In a configuration in which the first restrictor 31 and the second restrictor 32 differ in height as in the above example, the angle θ3 of the second restrictor 32 may be smaller than the angle θ2 of the first restrictor 31, or the angle θ3 may be larger than the angle θ2.

(4) In the above embodiment, a spherical object is shown as an example of the game objects B. However, the game objects B are not limited to the above example. For example, game objects B in the shape of a polyhedron (typically, a regular polyhedron or a semiregular polyhedron), or game objects B in a solid shape of a polyhedron with rounded corners can be used. As will be understood from the above explanations, the game objects B are solids objects that are rollable regardless of an orientation of the game objects B. A disk such as a token coin does not roll in an orientation where the planar front or back surface is grounded while rolling with the arc-like circumferential surface grounded. Therefore, such a disk is not an example of "solids rollable regardless of orientation." A typical example of "solids rollable regardless of orientation" is that of a solid of which an entire circumferential surface thereof is a curved surface (typically, a spherical object such as a marble). However, some solids that have a circumferential that is partially planar may constitute an example of "solids rollable regardless of orientation." For example, a substantially spherical polyhedron such as a truncated polyhedron is included within the concept of "solids rollable regardless of orientation."

(5) The first restrictor 31, the second restrictor 32 (321, and 32R), the third restrictor 41, the grooves 42, the protrusions 43, and the retaining members 44 shown as examples in the above embodiment are inclusively represented as elements (a suppressor) for suppressing an amount of movement (or an amount of motion) of game Objects B. Any one or more elements among the elements shown above as examples of the suppressor may be omitted. Further, the specific form of the suppressor is not limited to those provided as examples in the above embodiment. For example, an uneven portion located on the surface (the second surface S2) of the table 30 may be used as the suppressor. The uneven portion is configured to include at least one of a protrusion extending from the second surface S2 of the table 30 and a concave portion recessed from the second surface S2. It is of note that a range in which the amount of movement of the game objects B is suppressed can be limited by providing an uneven portion over only a predetermined area on the surface (the second surface S2) of the table 30. For example, an uneven portion can be provided within a predetermined range from the front edge E2 of the table 30.

APPENDIX

For example, the following configurations are understood based on the illustrative embodiments described above. In the following descriptions, reference signs in figures are denoted in parentheses, as appropriate, to facilitate understanding of each aspect, but the present invention is not limited to the aspects illustrated in the figures.

First Aspect

A game apparatus (1) according to a preferred aspect (first aspect) of the present invention includes a pusher (40) configured to reciprocate forward and backward on a surface of a table (30), the pusher (40) including a first surface (S1) that is an upper surface of the pusher (40); a feeder (50L, 50R) configured to feed a game object (B) that is rollable regardless of an orientation of the game object, onto the first surface (S1), and a suppressor (31, 31A, 31B, 31C, 32 (32L, 32R), 41, 41A, 41B, 41C, 42, 43, and 44) provided on at least one of the pusher (40) and the table (30) and configured to suppress an amount of movement of the game object (B). Since, according to this aspect an amount of movement of game objects B is suppressed, attractiveness of a pusher game is maintained such that game objects B are gradually moved and are caused to fall from the table (30).

Second Aspect

In a preferred example (second aspect) of the first aspect, the table (30) includes a second surface (S2) including a front part and a back part, with the front part including a front peripheral edge (E2), the second surface (S2) being inclined in a direction of reciprocation relative to a horizontal plane (H) such that the front part of the second surface (S2) is lower than the back part of the second surface (S2), and the suppressor includes a first restrictor (31) that protrudes from the second surface (S2) along the front peripheral edge (E2) of the second surface (S2). Because the second surface (S2) is inclined relative to the horizontal plane (H) in this aspect, game objects (B) can be concentrated in a vicinity of the front peripheral edge (E2) of the second surface (S2) of the table (30). Further, because the first restrictor (31) is provided along the front peripheral edge (E2) of the second surface (S2), game objects (B) are suppressed by the first restrictor (31) from freely falling from the front peripheral edge (E2). Therefore, attractiveness of the pusher game is maintained such that game object (B) are gradually moved and caused to fall from the table (30).

Third Aspect

In a preferred example (third aspect) of the second aspect, the second surface (S2) is inclined at a first angle (θ1) relative to the horizontal plane (H), the first restrictor (31) is inclined at a second angle (θ2) relative to the horizontal plane (H), and the second angle (θ2) is larger than the first angle (θ1). Because the first restrictor (31) is inclined relative to the horizontal plane (H) at the second angle (θ2) larger than the first angle (θ1) of the second surface (S2) in this aspect, the amount of movement of game objects (B) can be effectively suppressed.

Fourth Aspect

In a preferred example (fourth aspect) of the third aspect, the second surface (S2) further includes a peripheral edge (EL, ER) that is different from the front peripheral edge of the second surface (S2), the game apparatus (1) further includes a second restrictor (32L, 32R) that protrudes from the second surface (S2) along the peripheral edge (EL, ER) of the second surface (S2), the second restrictor (32L, 32R) is inclined at a third angle (θ3) relative to the horizontal plane (H), and the third angle (θ3) is larger than the first angle (θ1) and smaller than the second angle (θ2). Because the second restrictor (32L, 32R) is provided along the peripheral edge (EL, ER) of the second surface (S2), which is different from the front peripheral edge in this aspect, game objects (B) are suppressed by the second restrictor (32L, 32R) from freely falling (for example, so-called "fall from side holes") from the peripheral edge (EL, ER). Further, because the second restrictor (32L, 32R) is inclined relative to the horizontal plane (H) at the third angle (θ3) larger than the first angle (θ1) and smaller than the second angle (θ2), the amount of movement of game objects (B) can be effectively suppressed.

Fifth Aspect

In a preferred example (fifth aspect) of any of the first to fourth aspects, the first surface (S1) includes a front peripheral edge (E1) in a front part of the first surface (S1), and the suppressor includes a third restrictor (41) that protrudes from the first surface (S1) along the front peripheral edge (E1) of the first surface (S1). Since, according to this aspect the third restrictor (41) is provided along the front peripheral edge (E1) of the first surface (S1), game objects (B) are suppressed by the third restrictor (41) from freely falling from the front peripheral edge (E1). Therefore, the attractiveness of the pusher game can be maintained such that game objects (B) are gradually moved and are caused to fall from the table (30).

Sixth Aspect

In a preferred example (sixth aspect) of the fifth aspect, the first surface (S1) includes a front part and a back part, and the first surface (S1) is inclined in a direction of the reciprocation relative to a horizontal plane (H) such that the front part of the first surface (S1) is lower than the back part of the first surface (S1). Because the first surface (S1) is inclined relative to the horizontal plane (H) in this aspect, game objects (B) can be concentrated in a vicinity of the front peripheral edge (E1) of the first surface (S1) of the pusher (40).

Seventh Aspect

In a preferred example (seventh aspect) of the sixth aspect, the first surface (S1) is inclined at a fourth angle (θ4) relative to the horizontal plane (H), the third restrictor (41) is inclined at a fifth angle (θ5) relative to the horizontal plane (H), and the fifth angle (θ5) is larger than the fourth angle (θ4). Since according to this aspect the third restrictor (41) is inclined relative to the horizontal plane (H) at the fifth angle (θ5), which is larger than the fourth angle (θ4) of the first surface (S1), an amount of movement of game objects (B) can be effectively suppressed.

Eighth Aspect

In a preferred example (eighth aspect) of any of the first to seventh aspects, the suppressor includes a groove (42) formed on the first surface (S1), with the groove (42) extending in a direction of reciprocation. Because the groove (42) that extends in the direction of reciprocation of the pusher (40) is formed on the first surface (S1) in this aspect, game objects (B), fed in a direction intersecting with the direction of the reciprocation, are suppressed from freely reaching an end of the pusher (40) on the opposite side.

Ninth Aspect

In a preferred example (ninth aspect) of any of the first to eighth aspects, the pusher (40) includes a front part, the suppressor includes a retaining member (44) provided on the front part of the pusher (40), the retaining member (44) is of a concave shape as viewed from a direction of reciprocation, and the retaining member (44) is configured to retain the game object (B) on the pusher (40). Since, according to this aspect the concave retaining member (44) is provided on the front part of the pusher (40), game objects (B) having fallen from the first surface (S1) of the pusher (40) can be retained in the retaining member (44).

Tenth Aspect

In a preferred example (tenth aspect) of any of the first to ninth aspects, the pusher (40) includes an inclined surface (Sa) inclined in a direction from the first surface (S1) to a front part of the pusher (40), and the suppressor includes a protrusion (43) provided on the inclined surface (Sa), with the protrusion (43) protruding from the inclined surface (Sa). Since, according to this aspect the protrusion (43) is provided on the inclined surface (Sa) inclined in the direction from the first surface (S1) to the front part of the pusher (40), movement of game objects (B) having fallen from the first surface (S1) can be suppressed by the protrusion (43) on the inclined surface (Sa).

DESCRIPTION OF REFERENCE SIGNS

1: game apparatus, 10: operating panel, 11L,11R: operating portion, F: game field, 13: reader, 14: payout portion, 20: frame, 21L,21R: side wall portion, 23: front wall portion, 24: back wall portion, 26L,26R: opening, 27: shielding plate, 30: table, 31: first restrictor, 32: second restrictor, 40: pusher, 41: third restrictor, 42: groove, 43: protrusion, 44: retaining member, 441: concave portion, 442: guide path, 50L,50R: feeder, 60: detector, 61,62: light emitter, 70: hanged body, 71: pass hole, E1,E2: front edge, EL,ER: side edge, S0: reciprocation surface, S1: first surface, S2: second surface, Sa: inclined surface, Sb: push surface, B: game object, Q: fall port.

What is claimed is:

1. A game apparatus comprising:

a pusher configured to reciprocate forward and backward on a surface of a table, the pusher including a first surface that is an upper surface of the pusher;

a feeder configured to feed a game object that is rollable regardless of an orientation of the game object, onto the first surface; and a suppressor provided on at least one of the pusher and the table and configured to suppress an amount of movement of the game object, wherein the table includes a second surface including a front part and a back part, with the front part including a front peripheral edge, the second surface being inclined in a direction of the reciprocation relative to a horizontal plane such that the front part of the second surface is lower than the back part of the second surface, the suppressor includes a first restrictor that protrudes from the second surface along the front peripheral edge of the second surface, the second surface is inclined at a first angle relative to the horizontal plane, the first restrictor is inclined at a second angle relative to the horizontal plane, and the second angle is larger than the first angle.

2. The game apparatus according to claim 1, wherein the second surface further includes a peripheral edge that is different from the front peripheral edge of the second surface, the game apparatus further comprising a second restrictor that protrudes from the second surface along the peripheral edge of the second surface, wherein the second restrictor is inclined at a third angle relative to the horizontal plane, and the third angle is larger than the first angle and smaller than the second angle.

3. A game apparatus comprising:

a pusher configured to reciprocate forward and backward on a surface of a table, the pusher including a first surface that is an upper surface of the pusher;

a feeder configured to feed a game object that is rollable regardless of an orientation of the game object, onto the first surface; and a suppressor provided on at least one of the pusher and the table and configured to suppress an amount of movement of the game object, wherein the first surface includes a front peripheral edge at a front part of the first surface, and the suppressor includes a restrictor that protrudes from the first surface along the front peripheral edge of the first surface.

4. The game apparatus according to claim 3, wherein the first surface includes the front part and a back part, and the first surface is inclined in a direction of the reciprocation relative to a horizontal plane such that the front part of the first surface is lower than the back part of the first surface.

5. The game apparatus according to claim 4, wherein the first surface is inclined at an inclination angle relative to the horizontal plane, the restrictor is inclined at a restriction angle relative to the horizontal plane, and the restriction angle is larger than the inclination angle.

6. A game apparatus comprising:

a pusher configured to reciprocate forward and backward on a surface of a table, the pusher including a first surface that is an upper surface of the pusher;

a feeder configured to feed a game object that is rollable regardless of an orientation of the game object, onto the first surface; and a suppressor provided on at least one of the pusher and the table and configured to suppress an amount of movement of the game object, wherein the pusher includes a front part, the suppressor includes a retaining member provided on the front part of the pusher, the retaining member is concave in shape as viewed from a direction of the reciprocation, and the retaining member is configured to retain the game object on the pusher.

7. A game apparatus comprising:

a pusher configured to reciprocate forward and backward on a surface of a table, the pusher including a first surface that is an upper surface of the pusher;

a feeder configured to feed a game object that is rollable regardless of an orientation of the game object, onto the first surface; and a suppressor provided on at least one of the pusher and the table and configured to suppress an amount of movement of the game object, wherein the pusher includes a front part, and an inclined surface inclined in a direction from the first surface to the front part of the pusher, and the suppressor includes a protrusion provided on the inclined surface, with the protrusion extending from the inclined-surface.

* * * * *